US008968223B2

(12) United States Patent
Ikeuchi et al.

(10) Patent No.: US 8,968,223 B2
(45) Date of Patent: Mar. 3, 2015

(54) MOTION ASSIST DEVICE

(75) Inventors: Yasushi Ikeuchi, Wako (JP); Jun Ashihara, Wako (JP); Hiroshi Matsuda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 881 days.

(21) Appl. No.: 13/140,138

(22) PCT Filed: Dec. 15, 2009

(86) PCT No.: PCT/JP2009/006872

§ 371 (c)(1),
(2), (4) Date: Jun. 16, 2011

(87) PCT Pub. No.: WO2010/070879

PCT Pub. Date: Jun. 24, 2010

(65) Prior Publication Data

US 2011/0257567 A1 Oct. 20, 2011

(30) Foreign Application Priority Data

Dec. 17, 2008 (JP) ..... 2008-321023

(51) Int. Cl.
*A61H 1/02* (2006.01)
*A61H 3/00* (2006.01)

(52) U.S. Cl.
CPC ..... *A61H 3/008* (2013.01); *A61H 3/00* (2013.01); *A61H 2201/1633* (2013.01); *A61H 2201/5061* (2013.01); *A61H 2201/5069* (2013.01); *A61H 2201/1215* (2013.01); *A61H 2201/1436* (2013.01); *A61H 2201/1623* (2013.01); *A61H 2201/1635* (2013.01); *A61H 2201/1638* (2013.01); *A61H 2201/1642* (2013.01); *A61H2201/165* (2013.01); *A61H 2201/1671* (2013.01); *A61H 2201/1676* (2013.01)
USPC ..... 601/35; 601/5; 601/23; 601/33; 601/34; 602/16; 602/23

(58) Field of Classification Search
CPC . A61H 3/00; A61H 3/008; A61H 2201/1633; A61H 2201/1215; A61H 2201/165; A61H 2201/1623; A61H 2201/1635; A61H 2201/1638; A61H 2201/1642; A61H 2201/1671; A61H 2201/1676; A61H 2201/1436
USPC ..... 601/5, 23, 24, 26, 27, 33, 34, 35; 602/5, 602/12, 16, 20, 23, 27; 482/51, 66, 74–79; 135/65, 67
See application file for complete search history.

(56) References Cited

U.S. PATENT DOCUMENTS

| | | | | |
|---|---|---|---|---|
| 4,872,665 | A | 10/1989 | Charceire | |
| 6,666,796 | B1 * | 12/2003 | MacCready, Jr. | 482/66 |
| 7,278,979 | B2 * | 10/2007 | Shimada et al. | 602/16 |
| 8,079,967 | B2 * | 12/2011 | Ikeuchi et al. | 601/5 |
| 2007/0056592 | A1 * | 3/2007 | Angold et al. | 128/845 |

FOREIGN PATENT DOCUMENTS

| | | |
|---|---|---|
| JP | 2003-220102 | 8/2003 |
| JP | 2007-130234 | 5/2007 |
| JP | 2008-012224 | 1/2008 |
| JP | 2008-253539 | 10/2008 |

* cited by examiner

*Primary Examiner* — Quang D Thanh
(74) *Attorney, Agent, or Firm* — Rankin, Hill & Clark LLP

(57) ABSTRACT

Second joints are provided in positions where a seating unit is restrained from swinging relative to leg links due to a force acting on the seating unit from upper limb links through the intermediary of the second joints. A motion not intended by a user can be restrained from being generated due to a force acting from the upper limb links provided in the upper limbs.

3 Claims, 5 Drawing Sheets

MOTION ASSIST DEVICE

TECHNICAL FIELD

The present invention relates to a motion assist device which assists a walking motion of a user (human being) and the motions of upper limbs thereof.

BACKGROUND ART

Hitherto, as this type of a motion assist device, a human body motion assist device described in, for example, Japanese Patent Application Laid-Open No. 2007-130234 has a main body unit disposed adjacent to the front of a torso from a waist to shoulders. First power transmitting units disposed at the front surfaces of upper leg portions are connected through the intermediary of actuators provided on both sides of the lower portion of the main body unit. Second power transmitting units disposed at the front surfaces of lower leg portions are connected through the intermediary of actuators provided at the bottom ends of the first power transmitting units, and slipper-shaped foot holders are connected to the bottom ends of the second power transmitting units through the intermediary of movable connectors. Further, swingable shoulder members are provided on both sides of the upper portion of the main body unit, and third power transmitting units disposed at the front surfaces of upper arms through the intermediary of actuators disposed at the shoulder members are connected. Fourth power transmitting units disposed at the front surfaces of lower arms are connected to the bottom ends of the third power transmitting units through the intermediary of actuators, and grip-type or glove-shaped hand holders are connected to the distal ends of the fourth power transmitting units through the intermediary of movable connectors. Thus, the power imparted to the power transmitting units from the actuators enables the motion assist device to assist the motion of a physically handicapped person or an aged person or the like wearing the human body motion assist device.

DISCLOSURE OF INVENTION

Problem to be Solved by the Invention

However, in the aforesaid human body motion assist device described in Japanese Patent Application Laid-Open No. 2007-130234, the third and the fourth power transmitting units disposed at the arm portions (upper limbs) are connected to both sides of the upper portion of the main body unit through the intermediary of the shoulder members. Hence, when the power is imparted to the third or the fourth power transmitting unit from the actuators, a force acts on the main body unit through the intermediary of the shoulder members, the force adversely affecting a user. More specifically, the motions of arms are assisted by the actuators, so that a force not based on an intention of the user acts on a body trunk portion, leading to a danger that the force will cause the motion assist device to generate a motion not intended by the user.

In view of the aspects described above, an object of the present invention is to provide a motion assist device capable of restraining a force applied from upper limb links disposed in upper limbs from generating a motion not intended by a user.

Means to Solve the Problem

To fulfill the object described above, the present invention provides a motion assist device comprising: a weight supporting unit which supports a part of the weight of a user; a foot-worn unit to be attached to a foot of the user; a leg link which connects the foot-worn unit to the weight supporting unit; a first joint which connects the leg link to the weight supporting unit such that the leg link is free to swing at least in a longitudinal direction relative to the weight supporting unit; an upper-limb-worn unit to be attached to an upper limb of the user; an upper limb link which connects the upper-limb-worn unit to the weight supporting unit; a second joint which connects the upper limb link to the weight supporting unit such that the upper limb link is free to swing relative to the weight supporting unit; and a drive mechanism which drives a joint of the leg link, wherein the second joint is provided in a position where the weight supporting unit is restrained from swinging relative to the leg link due to a force acting on the weight supporting unit from the upper limb link through the intermediary of the second joint.

According to the present invention, the second joint, which connects the upper limb link to the weight supporting unit such that the upper limb link is free to swing relative to the weight supporting unit, is provided in a position where the weight supporting unit is restrained from swinging relative to the leg link due to a force acting on the weight supporting unit from the upper limb link through the intermediary of the second joint. Hence, even if a force, such as a gravitational force or an external force, acts on the weight supporting unit from the upper limb link through the intermediary of the second joint in a state wherein the user is wearing the motion assist device, the occurrence of a swing of the weight supporting unit swinging relative to the leg link is minimized. As a result, unlike the human body motion assist device described in the aforesaid Japanese Patent Application Laid-Open No. 2007-130234, a motion not intended by a user will be controlled, thus enabling the user to wear the motion assist device with security.

In the present invention, the second joint is preferably provided in a position where, for example, the magnitude of a moment which is generated due to a force acting on the weight supporting unit from the upper limb link through the intermediary of the second joint and which causes the weight supporting unit to rotate relative to the leg link does not exceed the magnitude of a moment which is generated due to a maximum frictional force produced between the weight supporting unit and the user and which prevents the weight supporting unit from rotating relative to the leg link.

With this arrangement, even if a moment which causes the weight supporting unit to rotate relative to the leg link is generated due to a force acting on the weight supporting unit from the upper limb link through the intermediary of the second joint, the magnitude of the moment can be prevented from exceeding the magnitude of the moment which prevents the weight supporting unit from rotating relative to the leg link by the maximum frictional force generated between the weight supporting unit and the user. In other words, the rotary moment of the weight supporting unit relative to the leg link which is generated due to the force acting from the upper limb link through the intermediary of the second joint can be cancelled by the moment attributable to the frictional force between the weight supporting unit and the user. As a result, it is possible to restrain the weight supporting unit from swinging relative to the leg link due to the force acting on the weight supporting unit from the upper limb link through the intermediary of the second joint.

Meanwhile, in the present invention, the swing of the weight supporting unit relative to the leg link can be restrained by setting the swing supporting point of the leg link at a position above the weight supporting unit rather than below the weight supporting unit. For this reason, preferably, the weight supporting unit is a seating unit on which the user sits astride, and the swing supporting point of the first joint related to a swing of the leg link in the longitudinal direction is positioned above the seating unit. This makes it possible to reduce the link length of the leg link, so that the motion assist device can be made smaller, as compared with a case where the swing supporting point of the leg link is positioned below the seating unit.

It is necessary, however, to prevent the user sitting on the seating unit from slipping due to a force acting on the seating unit from the upper limb link through the intermediary of the second joint. Hence, if it is assumed that the moment which causes the seating unit to rotate (swing) relative to the leg link due to the force acting on the seating unit from the upper limb link through the intermediary of the second joint is equal to the moment attributable to a frictional force against the rotation (swing) of the seating unit relative to the leg link due to a support assisting force acting on the user from the seating unit, then the coefficient of static friction between the seating surface of the seating unit and the user is 1 or less. Therefore, it is necessary to provide the swing supporting point of the second joint in a position within the distance from the swing supporting point of the first joint related to the swing of the leg link in the longitudinal direction to the seating surface.

Thus, preferably, the weight supporting unit is the seating unit on which the user sits astride, the swing supporting point of the first joint related to the swing of the leg link in the longitudinal direction is positioned above the seating unit, and the swing supporting point of the second joint is provided in a position within the distance from the swing supporting point of the first joint to the seating surface of the seating unit.

Further, the force acting on the second joint from the upper limb link is a downward force, such as the self-weight of an upper limb link or an upper limb of the user. According to the present invention, therefore, the second joint is preferably provided, for example, below the swing supporting point of the first joint related to the swing of the leg link in the longitudinal direction.

With this arrangement, the swing of the weight supporting unit relative to the leg link can be restrained, as compared with the case where the second joint is provided above the swing supporting point of the leg link. Especially if the weight supporting unit swings, dislocating itself from a stable position relative to the leg link, the weight supporting unit is promptly set back to the stable position, resulting in outstanding behavior stability.

MODE FOR CARRYING OUT THE INVENTION

Figure 1:
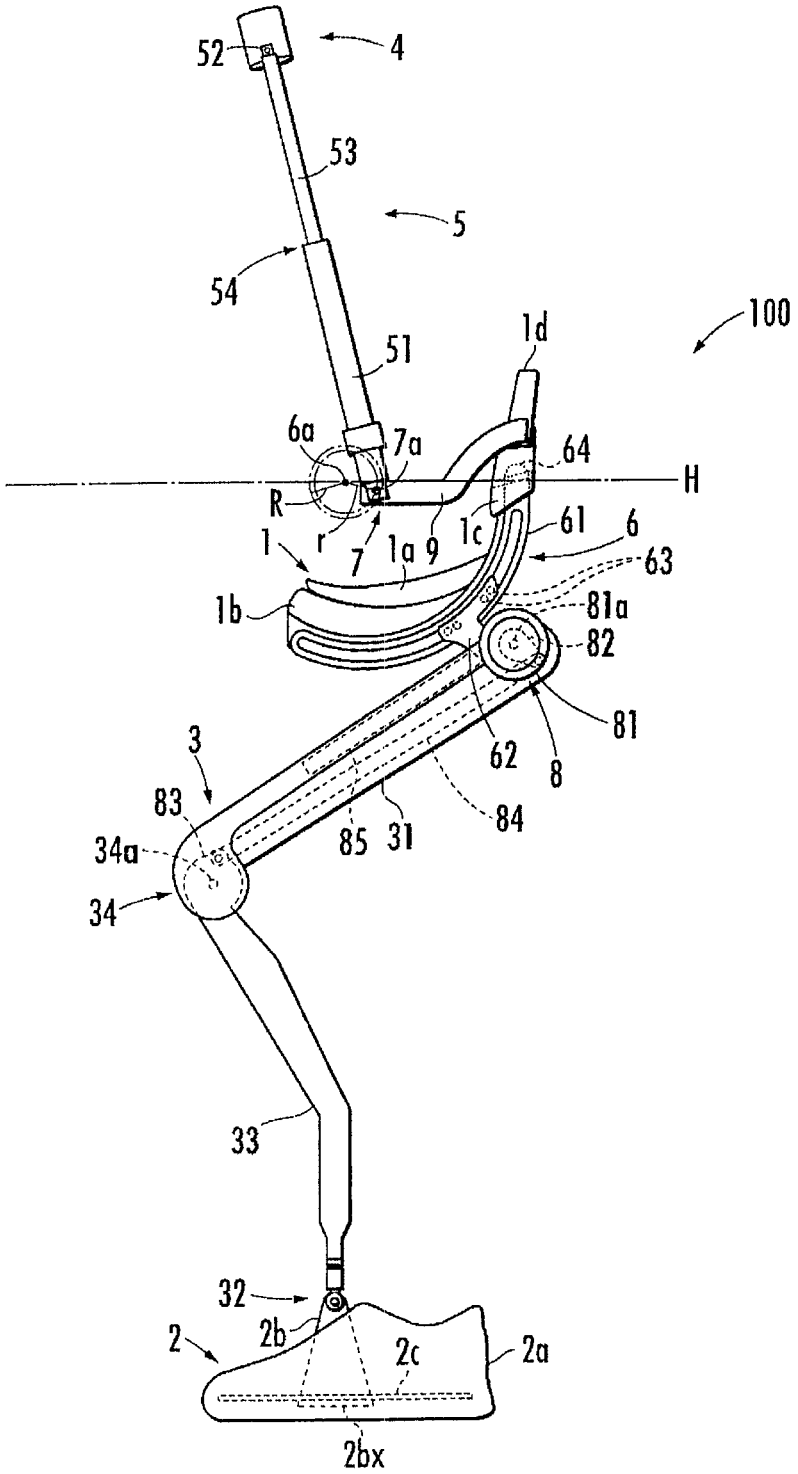
FIG. 1 It is a side view illustrating the schematic construction of a motion assist device according to a first embodiment of the present invention.
Figure 2:
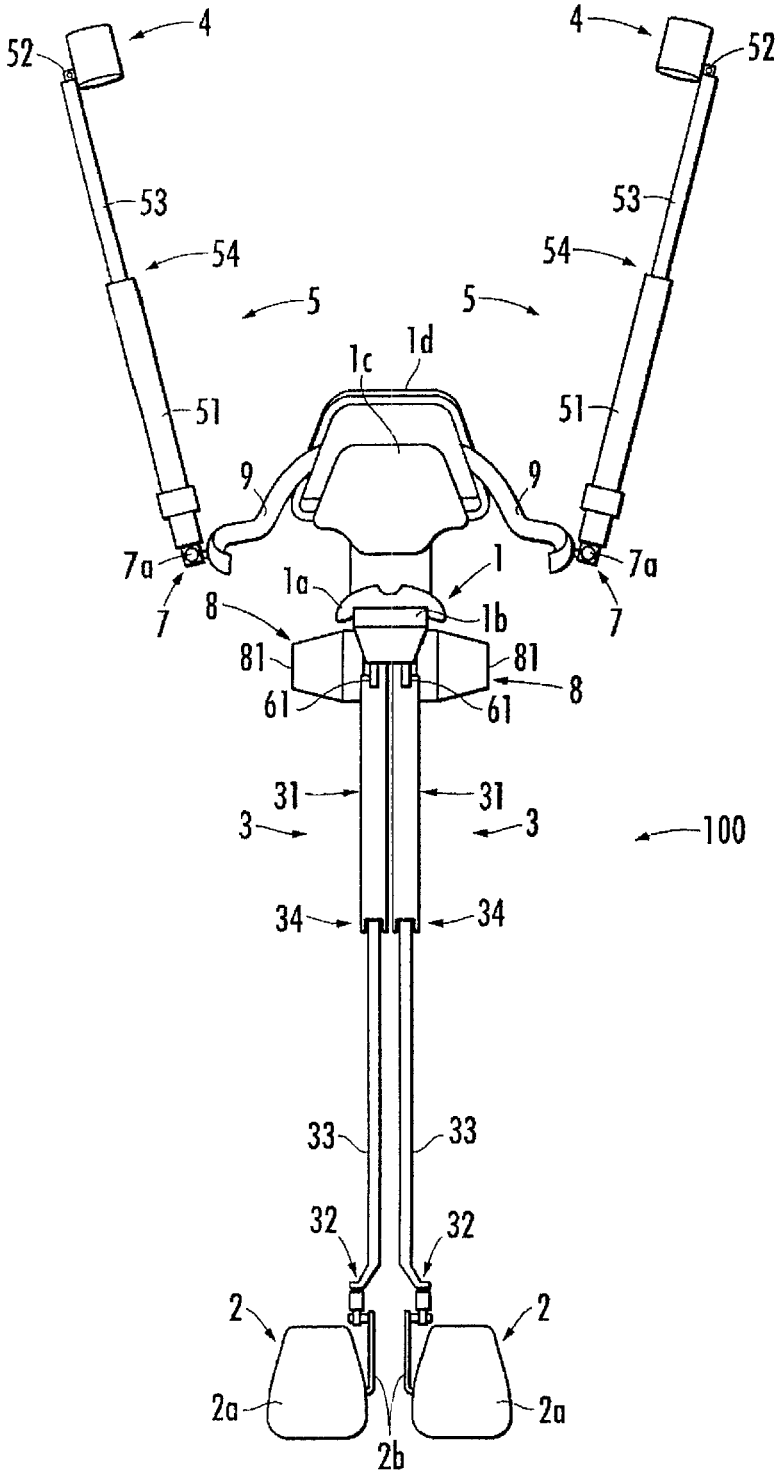
FIG. 2 It is a front view of the motion assist device according to the first embodiment.
Figure 3:
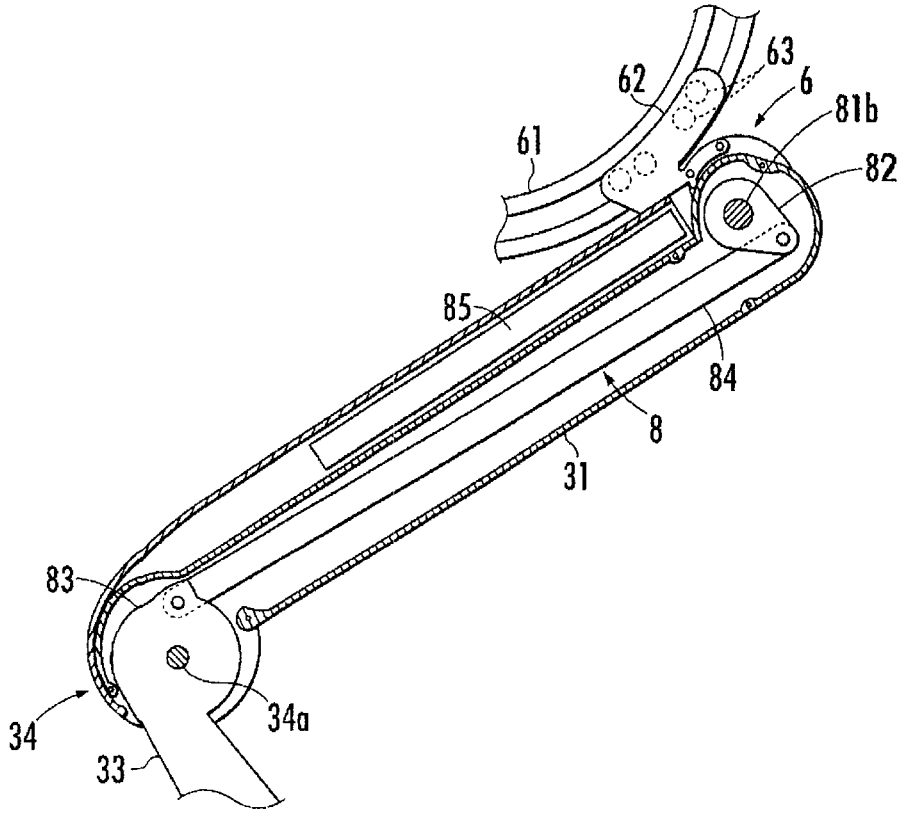
FIG. 3 It is a cutoff side view of an upper leg link of the motion assist device according to the first embodiment.

The following will describe a motion assist device 100 according to a first embodiment of the present invention with reference to FIG. 1 to FIG. 3.

The motion assist device 100 is provided with a seating unit 1 serving as a weight supporting unit, foot-worn units 2, 2 serving as a pair of right and left foot-worn units to be attached to the feet of the legs of a user (not shown), a pair of right and left leg links 3, 3 which respectively connect the foot-worn units 2, 2 to the seating unit 1, wrist-worn units 4, 4 serving as a pair of right and left upper-limb-worn units to be attached to the wrists of the upper limbs of the user, and a pair of right and left upper limb links 5, 5 which respectively connect the wrist-worn units 4, 4 to the seating unit 1. The right and left foot-worn units 2, 2, the leg links 3, 3, the wrist-worn units 4, 4, and the upper limb links 5, 5 share the same structures that are laterally symmetrical to each other. In the description of the present embodiment, the lateral direction of the motion assist device 100 means the lateral direction of the user wearing the foot-worn units 2, 2 (the direction perpendicular to the paper surface in FIG. 1).

Each of the leg links 3 is connected to the seating unit 1 by a first joint 6 such that the leg link may swing about a swing supporting point 6*a*. Each of the upper limb links 5 is connected by a second joint 7 to the seating unit 1 such that the upper limb link may swing about a swing supporting point 7*a*.

Each of the leg links 3 is comprised of an upper leg link member 31 extended downward via the first joint 6 from the seating unit 1, a lower leg link member 33 extended upward via an ankle joint 32 from a foot-worn unit 2, and a knee joint 34 which connects the upper leg link member 31 and the lower leg link member 33 such that the upper leg link member 31 and the lower leg link member 33 may bend and stretch between the first joint 6 and the ankle joint 32.

Each of the upper limb links 5 is comprised of an upper limb link member on the lower side 51 extended upward via the second joint 7 from the seating unit 1, an upper limb link member on the upper side 53 extended downward via a wrist joint 52 from a wrist-worn unit 4, and an elbow joint 54 which connects the upper limb link member on the lower side 51 and the upper limb link member on the upper side 53 such that upper limb links 51 and 53 may stretch and contract between the second joint 7 and the wrist joint 52.

Further, in the motion assist device 100, each leg link 3 is provided with a drive mechanism 8 for driving the knee joint 34. The drive mechanism 8 of the left leg link 3 and the drive mechanism 8 for the right leg link 3 share the same laterally symmetrical structure.

The seating unit 1 is comprised of a saddle-shaped seat portion 1*a* on which a user sits astride (which is disposed between the proximal ends of both legs of a user), a base frame 1*b* attached to the bottom surface of the seat portion 1*a*, and a hip pad 1*c* installed at the rear end of the base frame 1*b* (a rising portion which rises upward at the rear of the seat portion 1*a*). Further, the hip pad 1*c* is provided with an arch-shaped handle 1*d* which can be held by the user.

Each of the foot-worn units 2 has a shoe 2*a* in which a foot of the user is to be placed and a connecting member 2*b* which juts out upward from inside the shoe 2*a*. The foot-worn unit 2 comes in contact with the ground through the intermediary of the shoe 2*a* in a state wherein each of the legs of the user becomes a standing leg (supporting leg). Further, the bottom end of the lower leg link member 33 of each of the leg links 3 is connected to the connecting member 2*b* through the intermediary of the ankle joint 32. In this case, the connecting member 2*b* is integrally provided with a plate-shaped portion 2*bx* disposed under an insole 2*c* in the shoe 2*a* (between the bottom of the shoe 2*a* and the insole 2*c*).

Further, the connecting member 2*b* is formed of members, including the plate-shaped portion 2*bx*, which have a relatively high rigidity, so that a part of a floor reaction force acting on the foot-worn unit 2 from a floor (a support assisting force which is sufficiently large to support the weight combining at least the motion assist device 100 and a part of the weight of the user) can be applied to the leg link 3 through the intermediary of the connecting member 2*b* and the ankle joint 32 when the foot-worn unit 2 comes in contact with the ground. Incidentally, the foot-worn unit 2 may be provided with, for example, slipper-shaped footwear in place of the shoe 2*a*.

The ankle joint 32 in the present embodiment is constructed of a free joint, such as a ball joint, and has a freedom degree of rotation about three axes. Alternatively, however, the ankle joint 32 may be a joint having a freedom degree of rotation about, for example, two axes in the longitudinal and the lateral directions, or about two axes in the vertical and lateral directions.

The knee joint 34 positioned between the ankle joint 32 and the first joint 6, i.e., in the vicinity of a knee of the user, is a joint which has a freedom degree of rotation about one axis in the lateral direction. The knee joint 34 has a support shaft 34*a* which rotatably supports the upper end of the lower leg link member 33 at the bottom end of the upper leg link member 31. The axial center of the support shaft 34*a* is substantially parallel to a first joint axis (an axis in the direction perpendicular to a plane which includes the arc of a guide rail 61) of the first joint 6, which will be described later. Further, the axial center of the support shaft 34*a* provides a joint axis of the knee joint 34, allowing the lower leg link member 33 to relatively rotate about the joint axis relative to the upper leg link member 31. This enables the leg link 3 to bend and stretch at the knee joint 34.

The first joint 6 is a joint which has a freedom degree of rotation about two joint axes in the longitudinal and the lateral directions (2 degrees of freedom). More specifically, each of the first joints 6 is provided with the arch-shaped guide rail 61 attached to the base frame 1*b* of the seating unit 1. Further, a slider 62 fixed to the upper end of the upper leg link member 31 of each of the leg links 3 is movably engaged with the guide rail 61 through the intermediary of a plurality of rollers 63 rotatably attached to the slider 62. This enables each of the leg links 3 to perform a longitudinal swing motion (a longitudinal swing-out motion) about a first joint axis of the first joint 6, the first joint axis being the axis in the lateral direction that passes the center of the curvature of the guide rail 61 (more specifically, the axis in a direction perpendicular to a plane which includes the arc of the guide rail 61). This arrangement enables each of the leg links 3 to swing in the longitudinal direction relative to the seating unit 1, using the center of the curvature of the guide rail 61 as the swing supporting point 6*a*. Further, the first joint 6 is also allowed to swing in the longitudinal direction, using the center of the curvature of the guide rail 61 as the swing supporting point 6*a*.

Further, the guide rail 61 is rotatably supported by the rear upper end of the base frame 1*b* of the seating unit 1 through the intermediary of a support shaft 64, which has its axial center oriented in the longitudinal direction, thus allowing the guide rail 61 to swing about the axial center of the support shaft 64. This enables each of the leg links 3 to perform a lateral swing motion about a second joint axis (an inward/outward swing motion), using the axial center of the support shaft 64 as the second joint axis of the first joint 6. In the present embodiment, the second joint axis of the first joint 6 is shared by the right first joint 6 and the left first joint 6.

As described above, the first joint 6 is constructed so as to enable each of the leg links 3 to perform swing motions about the two joint axes in the longitudinal direction and the lateral direction.

The freedom degree of rotation of the first joint is not limited to two. The first joint may be constructed to have, for example, the freedom degree of rotation about three joint axes (3 degrees of freedom). Alternatively, the first joint may be constructed to have a freedom degree of rotation about, for example, only one joint axis in the lateral direction (1 degree of freedom).

Each of the drive mechanisms 8 is adapted to impart a rotational driving force (torque) in a direction in which the leg link 3 stretches relative to the knee joint 34 of the leg link 3, the foot-worn unit 2 of which is in contact with the ground to cause a load (upward support assisting force) for supporting a part of the weight of the user sitting on the seating unit 1 to act on the user from the seating unit 1.

The drive mechanism 8 is constructed of an electric motor 81 serving as a rotary actuator incorporating a speed reducer provided in the upper leg link member 31 of the leg link 3, a drive crank arm 82 on an output shaft 81*a* of the electric motor 81, a driven crank arm 83 fixed to the lower leg link member 33 coaxially with the support shaft 34*a* of the knee joint 34, and a connecting link 84, one end and the other end thereof being pivotally attached to the drive crank arm 82 and the driven crank arm 83, respectively.

Thus, the rotational driving force output from the output shaft 81*a* of the electric motor 81 is transmitted to the support shaft 34*a* of the knee joint 34 through the intermediary of a crank type rotation transmitting mechanism composed of the drive crank arm 82, the driven crank arm 83, and the connecting link 84. Further, the rotational driving force of the electric motor 81 enables the leg link 3 to bend and stretch at the knee joint 34. The upper leg link member 31 has an accessory 85, including a battery serving as the power source of the electric motor 81.

Each of the wrist-worn units 4 is a cylindrical component, which is detachably installed around each wrist of the user. The upper end of the upper limb link member 51 on the upper side of each of the upper limb links 5 is connected to a projection provided on the inner side in the lateral direction of the wrist-worn unit 4 through the intermediary of the wrist joint 52.

The wrist joint 52 in the present embodiment is constructed of a free joint, such as a ball joint, and consists of a joint having a freedom degree of rotation about three axes (spherical pair). Alternatively, however, the wrist joint may be a joint having a freedom degree of rotation about, for example, two axes in the longitudinal direction and the lateral direction or about two axes in the vertical direction and the lateral direction.

The elbow joint 54 is positioned between the wrist joint 52 and the second joint 7, i.e., at a height in the vicinity of an elbow of the user, and consists of a translational pair (sliding pair) having one degree of freedom in expanding/contracting directions relative to the upper limb link member on the lower side 51 of the upper limb link member on the upper side 53 in the present embodiment. The elbow joint 54 is formed of a cylinder mechanism in which the upper limb link member on the upper side 53 serving as a piston rod slides in the upper limb link member on the lower side 51 serving as a cylinder tube. The upper limb link member on the lower side 51 accommodates therein a coil spring (not shown) as an urging member, and the coil spring urges the upper limb link member on the upper side 53 so as to be spaced away from the upper limb link member on the lower side 51 in the lengthwise direction of the upper limb link member on the lower side 51. This arrangement enables the upper limb link 5 to stretch and contract at the elbow joint 54.

Each of the second joints 7 is provided on the distal end of the connecting member 9 secured to the handle 1*d* of the seating unit 1. With its proximal end secured to the outer side of the handle 1*d* in the lateral direction, each of the connecting members 9 is formed to extend downward from the proximal end, curving along the hip of the user sitting on the seating unit 1. The distal end of the connecting member 9 is provided with the second joint 7. The second joint 7 in the present embodiment is formed of a free joint, such as a ball joint, has a freedom degree of rotation about three axes, and is constructed to be able to swing relative to the seating unit 1 about the swing supporting point 7*a*. Alternatively, however, the second joint 7 may be a joint that has a freedom degree of rotation about, for example, two axes in the longitudinal direction and the lateral direction, or about two axes in the vertical direction and the lateral direction.

Although not shown, a control unit, including a microcomputer, is installed at an appropriate place of the motion assist device 100, e.g., in the base frame 1*b* of the seating unit 1 in order to control the operation of the electric motor 81 of the drive mechanism 8. Further, the motion assist device 100 is also provided with sensors for detecting, for example, the treading force of the user and the bending angle of each of the leg links 3, and the outputs of the sensors are used to control the operation of the electric motor 81.

In the motion assist device 100, the knee joint 34 of the leg link 3 in contact with the ground is driven so as to cause a load for supporting a part of the weight of the user (upward support assisting force) to steadily act on the user from the seating unit 1 when the user walks. More specifically, a support assisting force of a predetermined value (e.g., a support assisting force that supports a predetermined proportion (for example, 20%) of the weight of the user) is determined as a desired load to be applied to the user from the seating unit 1, and a necessary torque of the knee joint 34 required to generate the desired load (a required torque in the direction in which the leg link 3 stretches) is determined by arithmetic processing in the controller, which is not shown. Then, the output torque of the electric motor 81 is controlled to cause the required torque to act on the knee joint 34. This causes the desired load to act on the user from the seating unit 1, thus reducing a burden on a leg of the user.

Meanwhile, the upper limb of the user is urged upward by the urging force of the aforesaid coil spring, reducing the burden on the user when stretching his/her elbow. As a reaction force thereto, however, a force F from the upper limb link 5 acts on the seating unit 1 through the intermediary of the second joint 7, attempting to cause the seating unit 1 to swing relative to the leg link 3. The force F depends primarily on the self weights of the upper limb link 5 and the upper limb of the user, the reaction force against the urging force of the coil spring, and the maximum load assumed to be supported by the upper limb of the user.

Hence, the second joint 7 is provided in a position where the swing of the seating unit 1 relative to the leg link 3, which is generated due to the force F acting on the seating unit 1 from the upper limb link 5 through the intermediary of the second joint 7, is restrained. It is necessary, however, to provide the second joint 7 in a position where the user sitting on the seating unit 1 will not slip due to the force acting on the seating unit 1 from the upper limb link 5 through the intermediary of the second joint 7.

Here, considering that the second joint 7 has the freedom degree of rotation about three axes, the moment that causes the seating unit 1 to rotate (swing) relative to the leg link 3 by the force (translational force) F acting on the seating unit 1 from the upper limb link 5 through the intermediary of the second joint 7 will be rF at a maximum when the distance from the swing supporting point 6*a* to the swing supporting point 7*a* is denoted by r. Meanwhile, the maximum frictional force against the rotation of the seating unit 1 relative to the leg link 3 will be μW when the coefficient of the static friction between the seating surface of the front face of the seat 1*d* of the seating unit 1 and the user is denoted by μ and the support assisting force acting on the user from the seating unit 1 is denoted by W. Further, when the distance between the swing supporting point 6*a* and the seating surface, which is the front face of the seat portion 1*a*, is denoted by L, the maximum moment based on a frictional force against the rotation of the seating unit 1 relative to the leg link 3 will be denoted by μWL.

Further, if it is assumed that the moment that causes the seating unit 1 to rotate relative to the leg link 3 by the force F is equivalent to the moment attributable to the frictional force against the rotation of the seating unit 1 relative to the leg link 3 by the support assisting force W, then the static frictional coefficient μ is 1 or less, so that the swing supporting point 7*a* of the second joint 7 is required to be provided in a position within a distance L from the swing supporting point 6*a* of the leg link 3 to the seating surface.

In the present embodiment, the second joint 7 is provided in the position close to the swing supporting point 6*a* of the leg link 3 in the longitudinal direction relative to the seating unit 1. To be more specific, the swing supporting point 7*a* in the second joint 7 for the upper limb link 5 relative to the seating unit 1 is provided in a position in the vicinity of the swing supporting point 6*a* so that the distance r from the swing supporting point 6*a* of the leg link 3 lies within a predetermined distance R. As previously described, setting the distance r to the distance R (=μWL/F) or less prevents the seating unit 1 from rotating relative to the leg link 3 due to the force F acting on the seating unit 1 from the upper limb link 5 through the intermediary of the second joint 7. Thus, unlike the human body motion assist device described in the aforesaid Japanese Patent Application Laid-Open No. 2007-130234, a rotation not intended by a user does not occur, enabling the user to wear the motion assist device 100 with security.

If the distance r exceeds the distance R due to design restrictions or the like, then the second joint 7 is preferably provided below the swing supporting point 6*a* of the leg link 3 in the longitudinal direction relative to the seating unit 1. In the present embodiment, the swing supporting point 7*a* in the second joint 7 for the upper limb link 5 relative to the seating unit 1 is provided below a horizontal plane H which includes the swing supporting point 6*a*. With this arrangement, the stability of the posture of the seating unit 1 relative to the leg link 3 (the swing posture of the first joint 6 about the swing supporting point 6*a*) is enhanced, restraining the seating unit 1 from swinging relative to the leg link 3 due to the force F acting on the seating unit 1 from the upper limb link 5 through the intermediary of the second joint 7, as compared with the case where the second joint 7 is provided above the horizontal plane H.

It is especially preferable to provide the swing supporting point 7*a* at right below the swing supporting point 6*a* or in the vicinity thereof. In this case, even if the seating unit 1 swings, dislocating itself from a stable position thereof relative to the leg link 3, the seating unit 1 is promptly set back to the stable position, leading to enhanced stability of the posture of the seating unit 1 relative to the leg link 3 Hence, unlike the human body motion assist device described in the aforesaid Japanese Patent Application Laid-Open No. 2007-130234, the possibility of the occurrence of a large swing not intended by a user is minimized, enabling the user to wear the motion assist device 100 with security.

Figure 4:
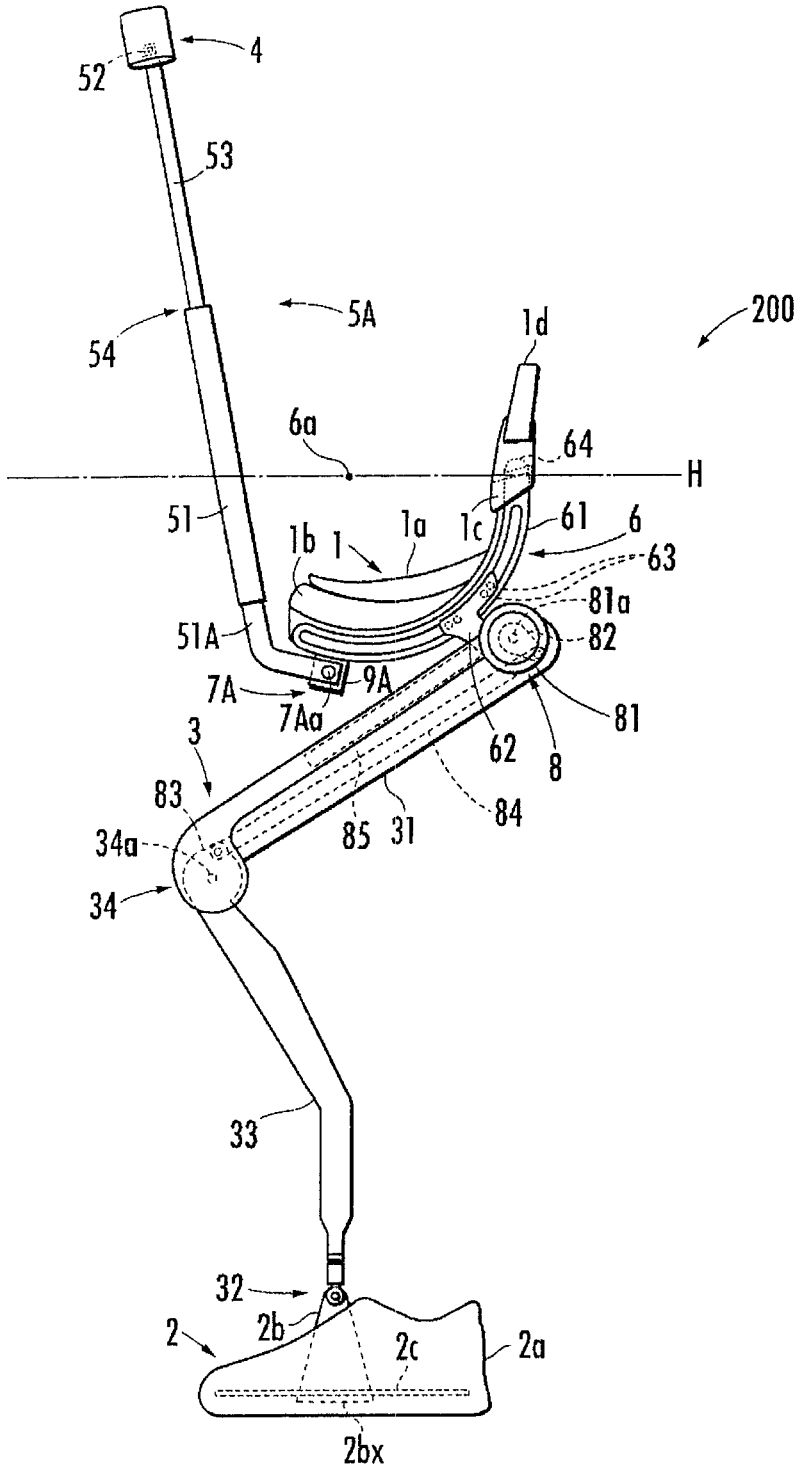
FIG. 4 It is a side view illustrating the schematic construction of a motion assist device according to a second embodiment of the present invention.
Figure 5:
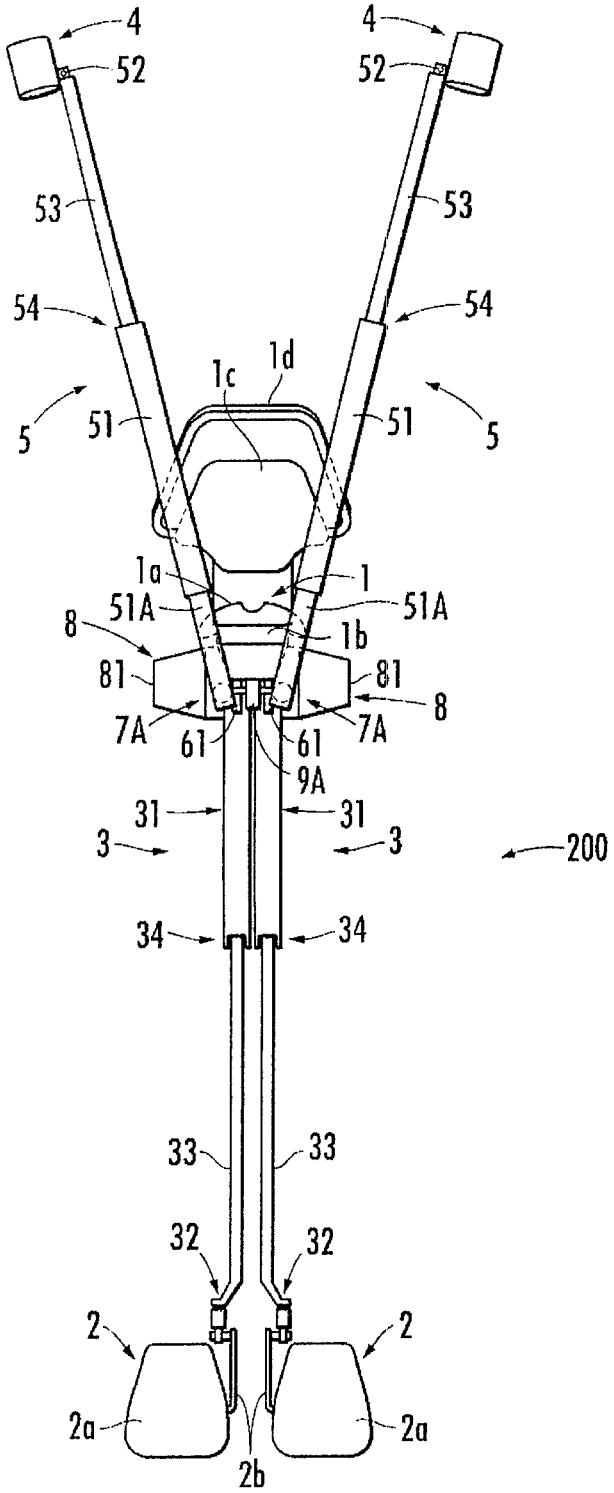
FIG. 5 It is a front view of the motion assist device according to the second embodiment.

The following will describe a motion assist device 200 according to a second embodiment of the present invention with reference to FIG. 4 and FIG. 5. The motion assist device 200 is similar to the motion assist device 100 described above, so that the description will be focused only on different aspects.

Each of the upper limb links 5A of the motion assist device 200 is connected by a second joint 7A such that the upper limb link 5A is allowed to swing around the swing supporting point 7Aa relative to the seating unit 1.

Each of the second joints 7A is provided on a connecting member 9A secured to the bottom surface of a supporting frame 1*b* of the seating unit 1. The connecting member 9A is secured at the lateral center of the bottom surface at the front of the supporting frame 1*b*, the second joint 7A being provided on the connecting member 9A. The second joint 7A in the present embodiment is constructed of a free joint, such as a ball joint, consists of a joint having a freedom degree of rotation about three axes, and is allowed to swing about the swing supporting point 7Aa relative to the seating unit 1. Alternatively, however, the second joint 7A may be a joint having a freedom degree of rotation about, for example, two axes in the longitudinal and the lateral directions, or about two axes in the vertical and the lateral directions. Further, the proximal end of an upper limb link member on the lower side 51 is secured to the distal end of a member 51A which extends upward from the second joint 7A, curving along the front bottom surface and the front surface of the supporting frame 1*b*.

Thus, the second joint 7A is provided below a swing supporting point 6*a* of a leg link 3 in the longitudinal direction relative to the seating unit 1. More specifically, the swing supporting point 7Aa in the second joint 7A for an upper limb link 5 relative to the seating unit 1 is provided below a horizontal plane H which includes the swing supporting point 6*a* of the leg link 3. With this arrangement, as with the motion assist device 100, the stability of the posture of the seating unit 1 relative to the leg link 3 (the swing posture of the first joint 6 about the swing supporting point 6*a*) is enhanced, restraining the seating unit 1 from swinging relative to the leg link 3 due to a force F acting on the seating unit 1 from the upper limb link 5 through the intermediary of the second joint 7A. This enables a user to wear the motion assist device 200 with security.

In the embodiments described above, the elbow joint 54 has been configured as a translational pair that allows the upper limb link member on the upper side 53 to stretch and contract relative to the upper limb link member on the lower side 51. Alternatively, however, the elbow joint 54 may be configured as a rotary pair that allows the upper limb link member on the upper side 53 to swing relative to the upper limb link member on the lower side 51. In this case, for example, the elbow joint 54 may be provided with a rotary actuator, such as an electric motor, and the rotational force of the rotary actuator may be used to swing the upper limb link member on the upper side 53 relative to the upper limb link member on the lower side 51.

As described above, the motion assist devices 100 and 200 have higher stability of the seating units 1 relative to the leg links 3 against swings generated due to the force F acting on the second joints 7 and 7A from the upper limb links 5 Hence, it is easier to control the drive of the rotary actuators provided in the elbow joints 54.

Further, the upper-limb-worn unit has been constructed of the wrist-worn unit 4 installed around a wrist. Alternatively, however, the upper-limb-worn unit may be constructed of a unit worn on any portion of an upper limb of a user, such as an upper arm, a lower arm or an elbow.

Further, a member for restricting the forward tilting of the upper limb link 5 may be provided. For example, the handle 1*d* of the seating unit 1 and the upper limb link member on the lower side 51 of the upper limb link 5 may be connected via a flexible belt.

Further, the weight supporting portion has been constructed of the seating unit 1 having a saddle-shaped seat portion 1*a*. Alternatively, however, the weight supporting portion may be constructed of a harness-shaped flexible member to be worn about the waist of a user. The weight supporting portion is preferably provided with a portion that comes in contact with a user at between the proximal ends of both legs in order to apply an upward support assisting force to the body trunk portion of a user.

Further, the first joint 6 has been configured to have the arch-shaped guide rail 61, and the center of the curvature of the guide rail 61 serving as the swing supporting point in the longitudinal direction of each of the leg links 3, i.e., the swing supporting point 6*a* in the longitudinal direction of the leg link 3 has been positioned above the seating unit 1. Alternatively, however, a simple joint structure in which, for example, the upper end of the leg link 3 is rotatably supported by a shaft in a crosswise direction (a lateral direction) besides or below the seating unit 1, may be used to enable the first joint 6 to swing at least in the longitudinal direction.

Further, in order to assist the walking of a user with a leg or upper limb crippled due to a broken bone or the like, only one of the right and left leg links 3 and 3 or only one of the right and left upper limb links 5 and 5 may be retained for the crippled leg or the crippled upper limb of the user, and the other leg link or upper limb link may be omitted.

The invention claimed is:

1. A motion assist device, comprising:

a weight supporting unit which supports a part of the weight of a user;

a foot-worn unit adapted to be attached to a foot of the user;

a leg link which connects the foot-worn unit to the weight supporting unit;

a first joint which connects the leg link to the weight supporting unit such that the leg link is free to swing at least in a longitudinal direction relative to the weight supporting unit;

an upper-limb-worn unit adapted to be attached to an upper limb of the user;

an upper limb link which connects the upper-limb-worn unit to the weight supporting unit;

a second joint which connects the upper limb link to the weight supporting unit such that the upper limb link is free to swing relative to the weight supporting unit; and a drive mechanism which drives a joint of the leg link, wherein the second joint is provided in a position where the weight supporting unit is restrained from swinging relative to the leg link due to a force acting on the weight supporting unit from the upper limb link through the second joint, and wherein the weight supporting unit is a seating unit on which the user sits astride, a swing supporting point of the first joint related to a swing of the leg link in the longitudinal direction is positioned above the seating unit, and a swing supporting point of the second joint is provided at a position between a seating surface of the seating unit and a horizontal plane which includes the swing supporting point of the first joint, so that the swing supporting point of the second joint is disposed below the horizontal plane.

2. The motion assist device according to claim 1, wherein the second joint is provided in a position where a magnitude of a moment which is generated due to a force acting on the weight supporting unit from the upper limb link through the second joint and which causes the weight supporting unit to rotate relative to the leg link does not exceed the magnitude of a moment which is generated due to a maximum frictional force produced between the weight supporting unit and the user and which prevents the weight supporting unit from rotating relative to the leg link.

3. The motion assist device according to claim 1, wherein the second joint is provided below the swing supporting point of the first joint related to the swing of the leg link in the longitudinal direction.

* * * * *